US012678655B2

(12) United States Patent
Byun

(10) Patent No.: US 12,678,655 B2
(45) Date of Patent: Jul. 14, 2026

(54) ADJUSTABLE LOW PULLEY

(71) Applicant: NEWTECH WELLNESS CO., LTD., Gimhae-si (KR)

(72) Inventor: Hyun Jung Byun, Busan (KR)

(73) Assignee: NEWTECH WELLNESS CO., LTD., Gimhae-si (KR)

( * ) Notice: Subject to any disclaimer, the term of this patent is extended or adjusted under 35 U.S.C. 154(b) by 257 days.

(21) Appl. No.: 18/226,807

(22) Filed: Jul. 27, 2023

(65) Prior Publication Data

US 2024/0066347 A1 Feb. 29, 2024

Related U.S. Application Data

(63) Continuation of application No. PCT/KR2022/019663, filed on Dec. 6, 2022.

(30) Foreign Application Priority Data

Aug. 24, 2022 (KR) ..... 10-2022-0106438

(51) Int. Cl.
*A63B 21/00* (2006.01)
*A63B 21/062* (2006.01)

(52) U.S. Cl.
CPC ..... *A63B 21/156* (2013.01); *A63B 21/0628* (2015.10); *A63B 2208/0233* (2013.01)

(58) Field of Classification Search
CPC ..... A63B 21/156; A63B 21/0628; A63B 2208/0233; A63B 21/151; A63B 23/03541; A63B 2071/009; A63B 2071/065; A63B 2071/0658; A63B 2208/0204; A63B 2208/0228
See application file for complete search history.

(56) References Cited

U.S. PATENT DOCUMENTS 4,199,139 A * 4/1980 Mahnke ..... A63B 21/0632 482/101
4,900,018 A * 2/1990 Ish, III ..... A63B 21/154 482/138
5,151,071 A * 9/1992 Jain ..... A63B 21/0783 482/99

(Continued)

FOREIGN PATENT DOCUMENTS

CN 213912203 U 8/2021
KR 10-0616416 B1 8/2006
KR 10-1689825 B1 12/2016

OTHER PUBLICATIONS

International Search Report for PCT/KR2022/019663 mailed May 19, 2023 from Korean Intellectual Property Office.

*Primary Examiner* — Garrett K Atkinson
(74) *Attorney, Agent, or Firm* — Revolution IP, PLLC

(57) ABSTRACT

An adjustable low pulley according to an embodiment of this invention is an equipment that can be used to perform exercises by pulling a weight with an arm while being seated, which connects a support frame standing in an upright position while being supported on the floor, a seating unit connected to the front of the support frame to provide a space for seating, and the support frame, it is connected to a weight unit composed of multiple block weights and to the above weight unit. It includes an external force transmission unit for transmitting an external force to allow the weight to move up and down by the applied external force while the seated user grips it.

4 Claims, 9 Drawing Sheets

(56) References Cited

U.S. PATENT DOCUMENTS

| | | | | |
|---|---|---|---|---|
| 6,231,486 | B1 * | 5/2001 | Lee | A63B 21/4001 482/102 |
| 6,394,935 | B1 * | 5/2002 | Lake | A63B 21/4013 482/93 |
| 7,303,506 | B1 * | 12/2007 | Reynolds | A63B 23/12 482/37 |
| 7,981,010 | B1 * | 7/2011 | Webber | A63B 21/4031 482/137 |
| 2003/0060345 | A1 * | 3/2003 | Piane, Jr. | A63B 21/154 482/100 |
| 2006/0264305 | A1 * | 11/2006 | Klassen | A63B 21/156 482/99 |
| 2008/0248929 | A1 * | 10/2008 | Webber | A63B 21/0628 482/96 |
| 2008/0287270 | A1 * | 11/2008 | Carter | A63B 23/12 482/99 |
| 2010/0041520 | A1 * | 2/2010 | Popescu | A63B 23/1209 482/37 |
| 2010/0227745 | A1 * | 9/2010 | Kjellberg | A63B 21/0628 482/98 |
| 2015/0182773 | A1 * | 7/2015 | Olson | A63B 23/03541 482/92 |
| 2016/0346590 | A1 * | 12/2016 | Giannelli | A63B 21/4035 |
| 2017/0157455 | A1 * | 6/2017 | Kelly | A63B 22/0012 |
| 2019/0240525 | A1 * | 8/2019 | Leipheimer | A63B 21/0724 |
| 2024/0325815 | A1 * | 10/2024 | Larson | A63B 21/151 |

* cited by examiner

ADJUSTABLE LOW PULLEY

TECHNICAL FIELD

This invention works in relation to an adjustable low pulley. Specifically, it relates to an exercise equipment capable of performing workouts by pulling a weight with an arm while being seated.

BACKGROUND ART

Recently, as social interest concerning beauty and health continues to increase, the number of fitness population persistently performing weight training to improve muscle strength and create a balanced body also continues to increase. Weight training is an exercise aimed at strengthening muscles using heavily weighted objects, such as a barbell or dumbbell, and gaining improved physical strength from it.

There are various actions used in weight training, such as bench press, squat, deadlift, and many gyms are equipped with such diverse fitness equipment to carry out these physical actions during workouts.

Recently, as the public continues to show increased interest in health-related topics, it has become very easy to gain relevant knowledge thanks to the development of media associated with various exercise postures.

However, since many exercise equipment are very costly, most people pay a fee to use the equipment at the gym. However, in often cases, they have to wait to use the desired exercise equipment when there are a lot of people at certain times of the day or on public holidays.

Therefore, there is an increasing need for exercise equipment that allows people to perform various workout actions without taking up a large space.

In particular, there is a high demand for the development of exercise equipment that bring out deep stimulation to various parts of the body such as the back and those that require operation using one or both arms.

PRIOR ART LITERATURE

Patent Literature (Patent Document 1) Korea Patent Registration No. 10-1689825

DISCLOSURE OF INVENTION

Tasks to be Resolved

This invention aims to provide an exercise equipment that allows users to perform back exercises by pulling a weight with an arm while being seated.

Means to Resolve Tasks

An adjustable low pulley according to an embodiment of this invention is an equipment that can be used to perform exercises by pulling a weight with an arm while being seated, which connects a support frame standing in an upright position while being supported on the floor, a seating unit connected to the front of the support frame to provide a space for seating, and the support frame, it is connected to a weight unit composed of multiple block weights and to the above weight unit. It includes an external force transmission unit for transmitting an external force to allow the weight to move up and down by the applied external force while the seated user grips it. The external force transmission unit is equipped with a pulley unit that changes the direction of the force applied to the external force application unit in the vertical direction while stipulating the main external force body connected to the support frame, the external force application unit providing a space for the gripping, the cable mediating the external force application unit and the weight unit, and the movement path of the cable.

The support frame of the adjustable low pulley according to an embodiment of this invention is formed by a floor support unit settled on the floor and by standing in an upright position from the floor support unit, and it s formed by standing in an upright position from the external force support unit and the floor support unit, which provides a space where the external force transmission unit is mounted, and it is equipped with a standing support unit that provides a space where the weight unit is mounted. The main external force body is mounted to allow for the up and down movement of the external force support unit, and the external force application unit shall be equipped with a primary grip unit connected to one end of the cable and a secondary grip unit connected to the other end of the cable. The pulley unit may allow the external force applied by the user to be transmitted to the weight unit by mediating the external force application unit and the weight unit.

The pulley unit of the adjustable low pulley according to an embodiment of this invention is connected to a primary main pulley piece connected to the main external force body and to the main external force body, and connected to a secondary main pulley piece placed adjacent to the primary main pulley piece, a primary upper pulley piece connected to the upper part of the standing support unit, a weight pulley piece connected to the above weight unit, and the upper part of the standing support unit while being equipped with a secondary upper pulley piece placed on the upper side of the weight pulley piece and a lower pulley piece connected to the bottom support unit. The cable connected to the primary grip unit passes through the primary main pulley piece, the primary upper pulley piece, the weight pulley piece, the secondary upper pulley piece, the lower pulley piece, and the secondary main pulley piece in sequential order to be connected to the secondary grip unit. The weight unit may increase in proportion to a moving distance of the primary grip unit from the primary main pulley piece or a moving distance of the secondary grip unit from the secondary main pulley piece by the user.

The weight unit of the adjustable low pulley according to an embodiment of this invention penetrates multiple block weights connected to the standing support unit that allows for up and down movement, and a through-hole formed in the block weight while the lower end is connected to the floor support unit, and the upper end is equipped with a weight adjustment unit that allows the position to be moved integrally using block weights stacked on top of inserted block weights by connecting to the upper end of the standing support unit and inserting it into the lower end of any one of the guide unit and multiple block weights that guide the horizontal path of the block weight. The seat unit may be equipped with a connection unit formed in an "L" shape while being connected to the floor support unit, and a seating unit connected to an upper end of the connection unit to provide a space for seating.

The support frame of the adjustable low pulley according to an embodiment of this invention is further equipped with a footrest support unit placed between the external force support unit and the seating unit while being connected to the stool support unit, and it also includes a footrest unit that provides a space where the seated user can place his or her feet. The stool support unit is composed of a primary stool support piece and a secondary stool support piece placed apart from each other, and the footrest unit is equipped with a primary stool piece mounted on the primary stool support piece and a secondary stool piece mounted on the secondary stool support piece, and the primary stool piece shall be mounted on the primary stool support piece, and provide a hanging unit to support the user's feet supported on the opposite sides with a mounting unit providing opposite sides toward the seating units and bent from the lower end of the above mounting unit.

Effects of the Invention

According to this invention, the pulley is created to allow for the direction of force to be changed smoothly between the cable pulled by the user and the weight, which would demonstrate effective power transmission via the cable, and by minimizing the friction between the cable and the member of framework, the horizontal movement of the weight by the cable is stably demonstrated.

In addition, various back exercises can be performed by configuring the weight to be pulled with both arms simultaneously or by alternating between the two arms.

Also, various pulling angles have allowed for diversity through the vertical adjustment of the pulley.

BRIEF DESCRIPTION OF DRAWINGS

Drawings 1 and 2 are schematic views that show an adjustable low pulley according to an embodiment of this invention.

Drawing 3 is a schematic view that describes a support frame of an adjustable low pulley according to an embodiment of this invention.

Figure 1:
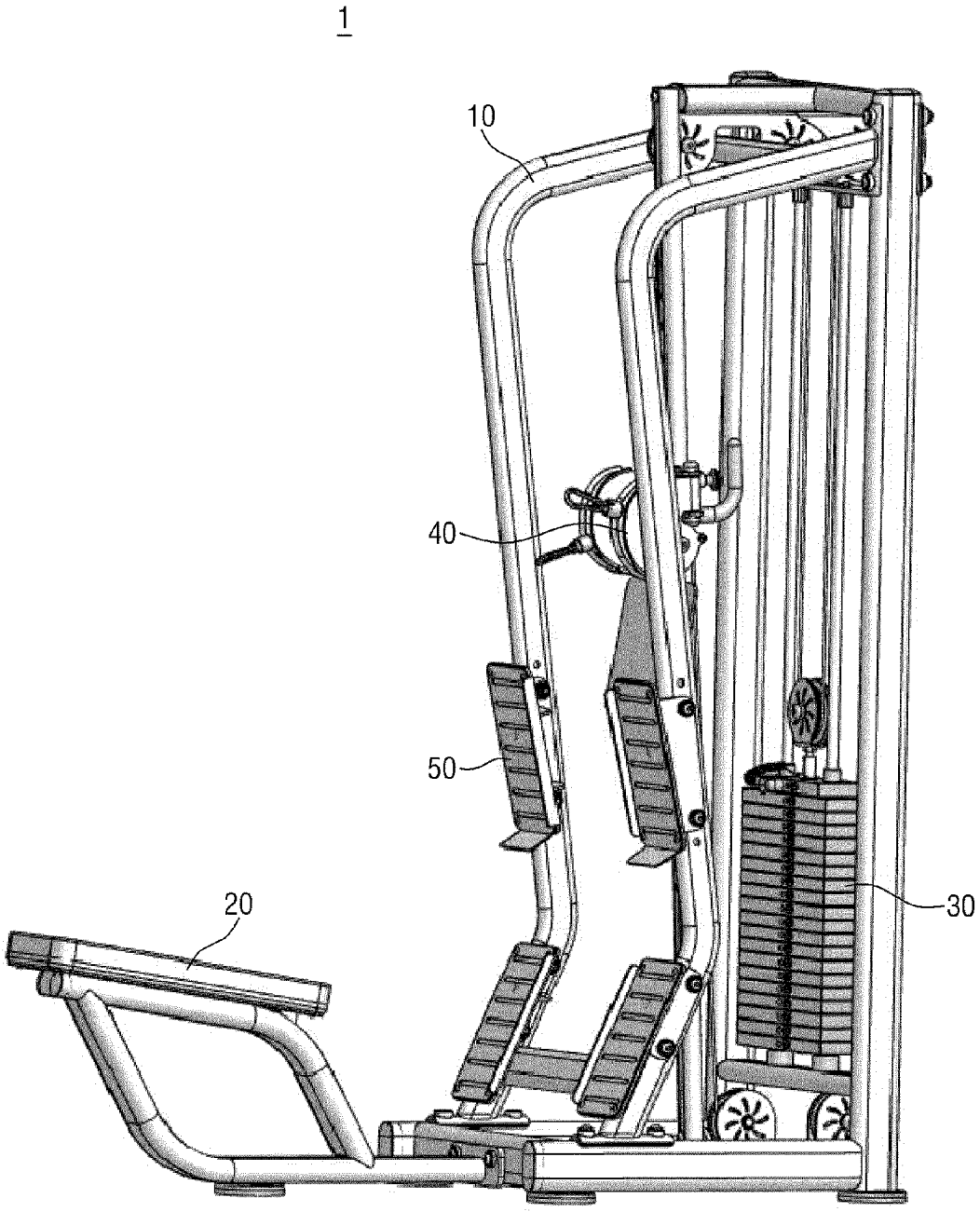
Figure 2:
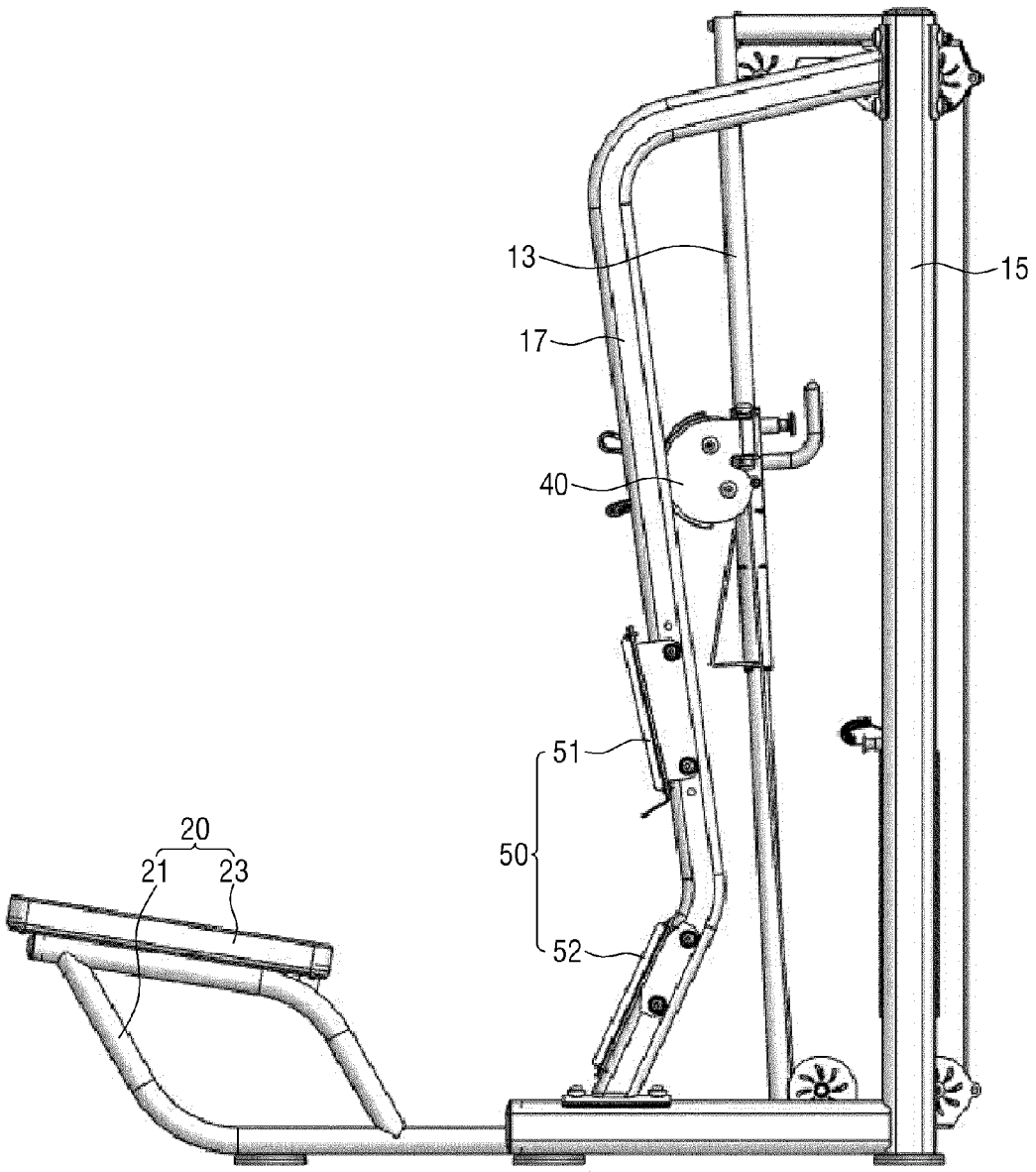
Figure 3:
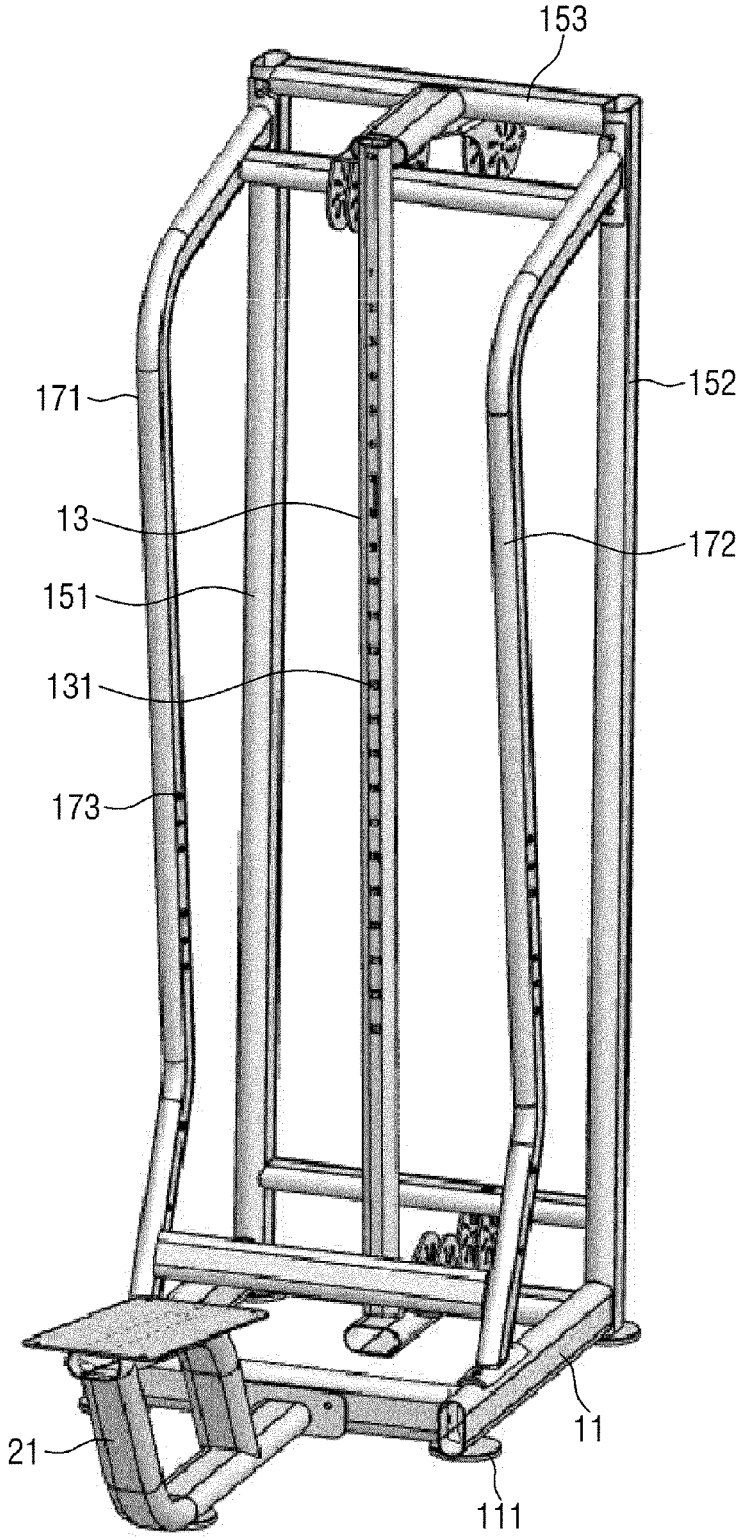
Figure 4:
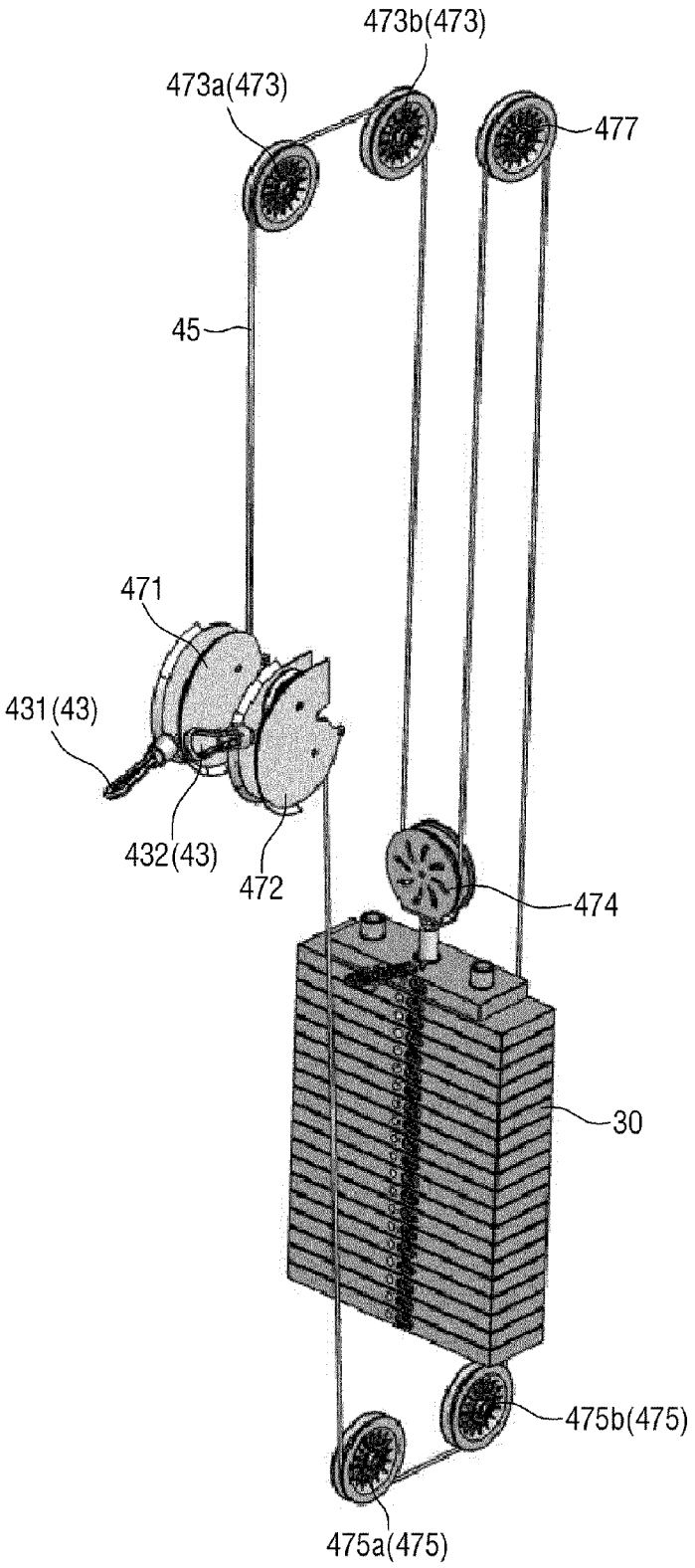
Figure 5:
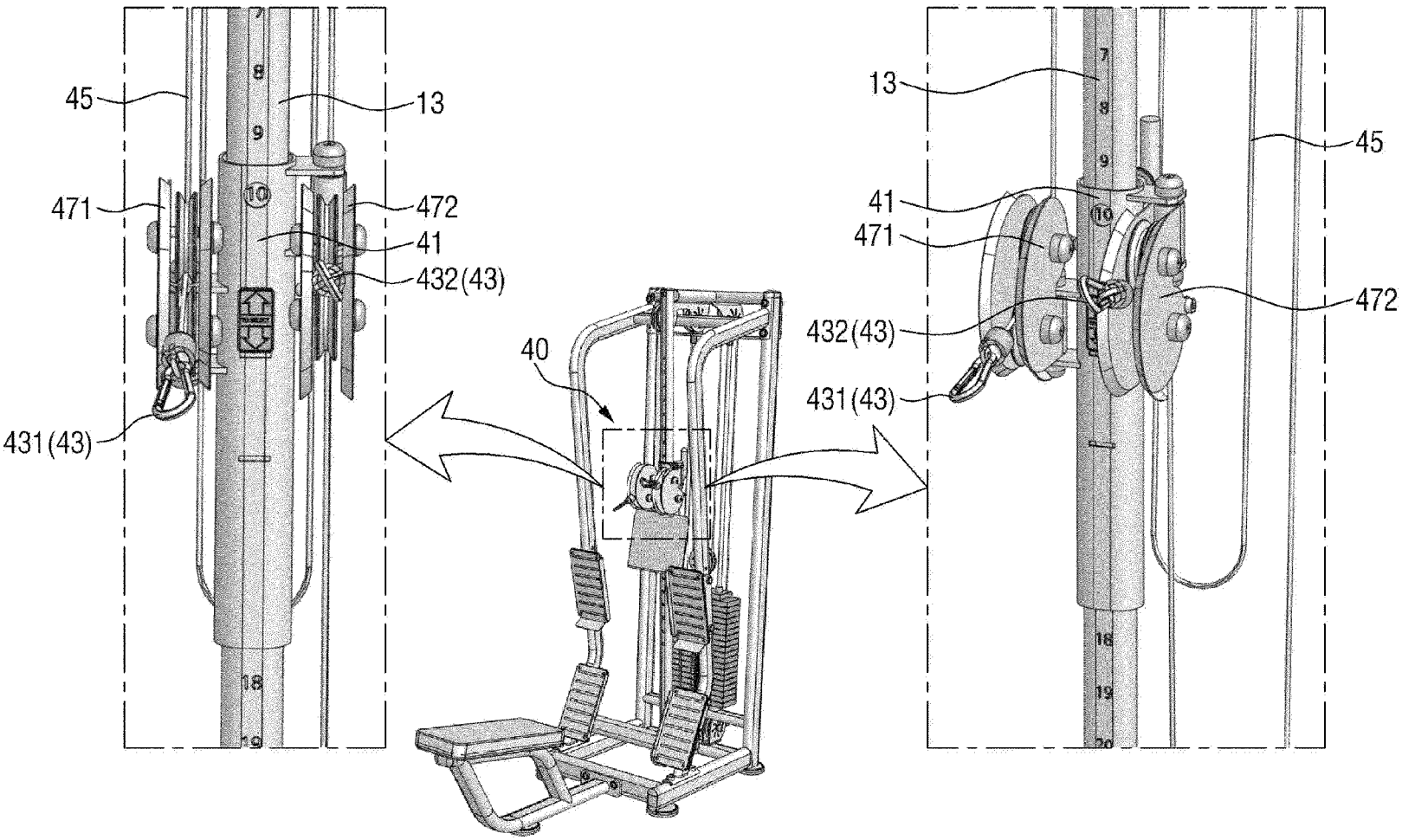
Figure 6:
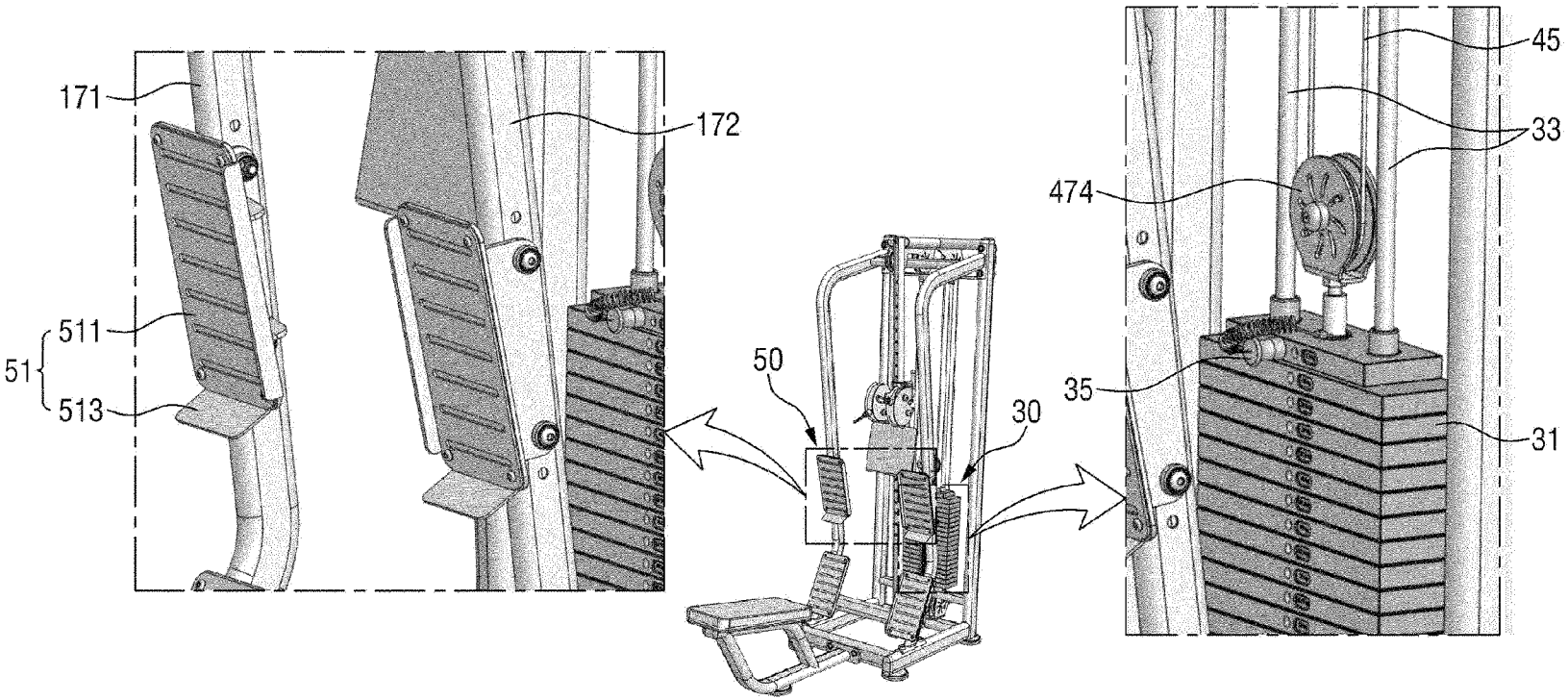
Figure 7:
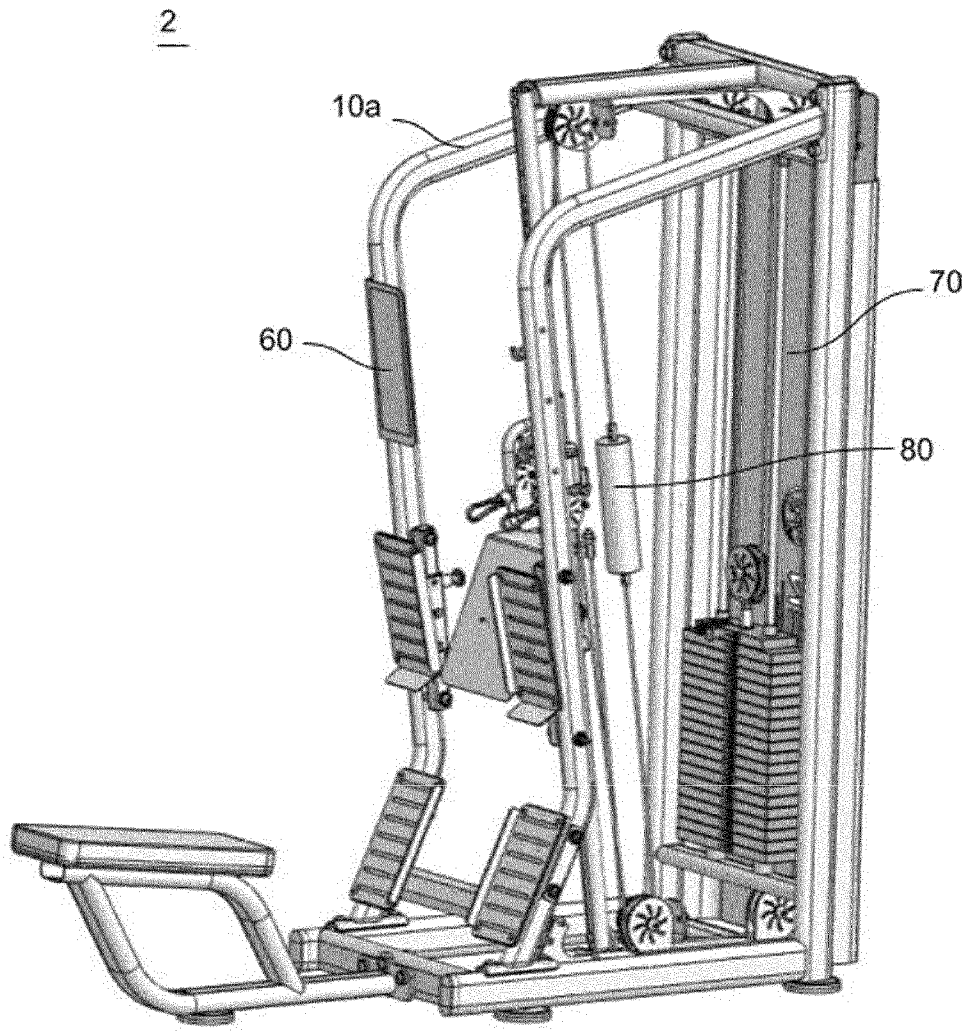
Figure 8:
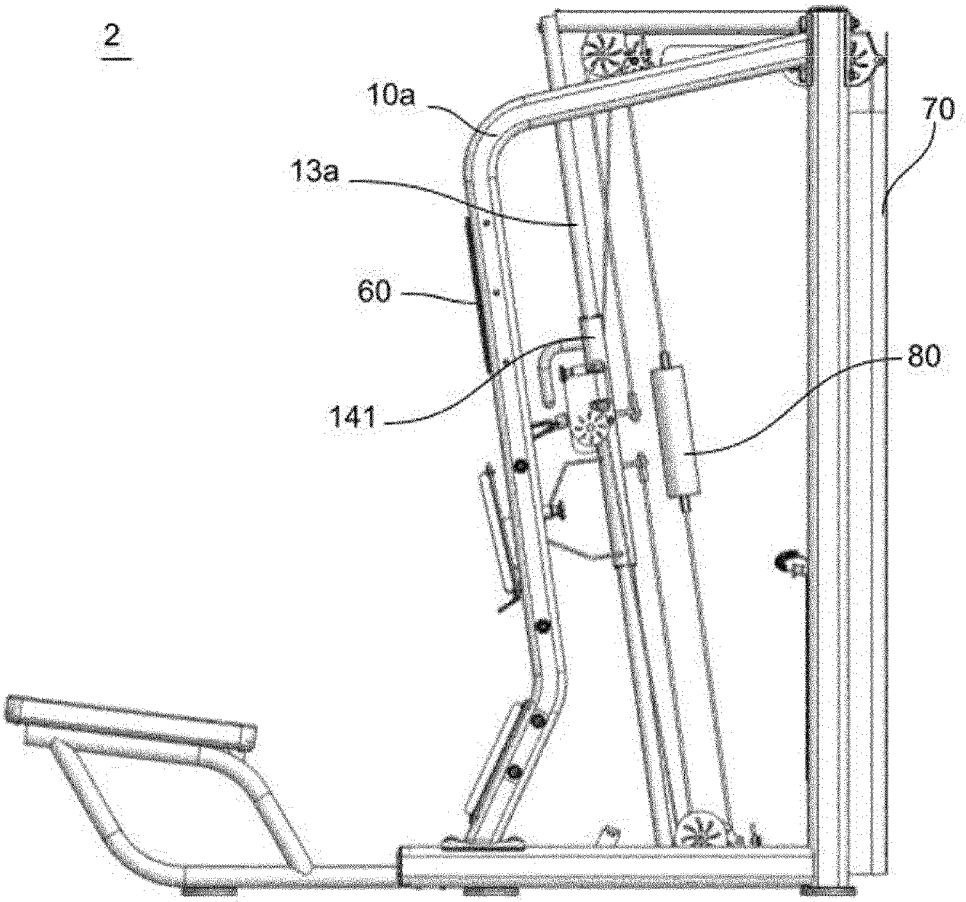
Figure 9:
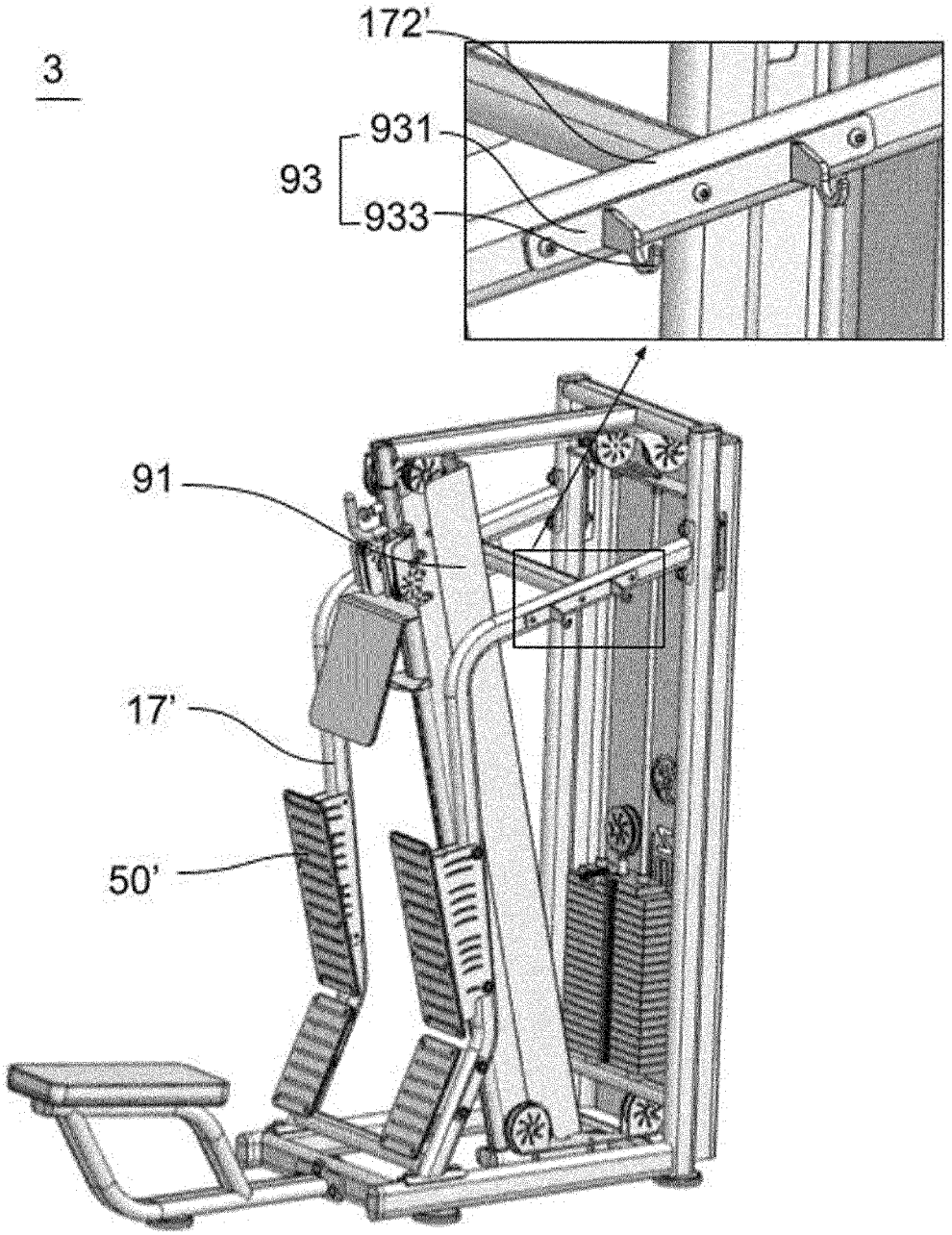

Drawings 4 and 5 are schematic views that describes an external force transmission unit of an adjustable low pulley according to an embodiment of this invention.

Drawing 6 is a schematic view that describes the weight unit and a stool support unit of an adjustable low pulley according to an embodiment of this invention.

Drawings 7 and 8 are schematic views that describes an adjustable low pulley according to a different embodiment of this invention.

Drawing 9 is a schematic view that describes an adjustable low pulley according to another embodiment of this invention.

SPECIFIC DETAILS FOR IMPLEMENTATION OF THE INVENTION

Specific embodiments of this invention will be described in detail with reference to the drawings below. However, ideas concerning this invention shall not be limited to the presented examples, and the person skilled in the relevant field of technology will be able to easily suggest other regressive inventions or other embodiments that are included within the scope of the relevant idea by adding, changing, or deleting other elements within the scope of the same relevant ideas. However, it would also be included within the scope of the ideas relevant to this invention.

In addition, elements that hold the same function within the scope of the identical idea exhibited in the drawings of each embodiment are described using the same reference symbols.

Drawings 1 and 2 shows a schematic view of an adjustable low pulley according to an embodiment of this invention, and Drawing 3 is a schematic view that describes a support frame of an adjustable low pulley according to an embodiment of this invention.

In reference to Drawings 1 to 3, an adjustable low pulley (1, hereinafter referred to as a low pulley) according to an embodiment of this invention is an equipment that can be used to perform exercises by pulling a weight with an arm while being seated.

The low pulley (1) of this invention activates the linkage between the trapezius muscle and the latissimus dorsi muscle and the erector muscle of the user by performing the action of pulling the cable (45) connected to the weight, which would allow the user to perform exercises to help develop the overall muscular function.

The low pulley (1) of this invention may include a support frame (10), a seat (20), a weight unit (30), and an external force transmission unit (40).

The support frame (10) may be standing while being supported by the floor, and may be equipped with a floor support unit (11), an external force support unit (13), and a standing support unit (15).

The floor support unit (11) is mounted on the floor, and multiple connection units created by square or circular tubes are connected to allow for the components connected to the upper part are stably supported on the floor. Multiple floor mounting units (111) may be formed on the lower part of the floor support unit (11) to prevent slipping by increasing the frictional force with the floor.

The standing support unit (15) is created by an upright standing placement from the floor support unit (11) and may provide a space where the weight unit (30) is to be mounted. The standing support unit (15) shall be composed of a primary standing piece (151) and a secondary standing piece (152) that are placed apart from each other, and a standing connection unit (153) connecting the upper ends of the primary standing piece and the second standing piece.

The external force support unit (13) is created by an upright standing placement from the floor support unit (11), which can provide a space where the external force transmission unit (40) is to be mounted, and it may be placed perpendicular to the floor while being connected to the standing connection unit (153).

In addition, the external force support unit (13) is placed between the standing support unit (15) and the seat (20), and the seated user (20) can apply an external force to the external force transmission unit (40) mounted on the external force support unit (13).

The seat (20) can be connected to the front of the support frame (10) to provide a space for seating.

Specifically, the seat (20) is equipped with a connection unit (21) formed in an "L" shape while being connected to the floor support unit (11), and a seating unit (23) connected to an upper end of the connection unit (21) to provide a space for seating.

The weight unit (30) shall be connected to the support frame (10) and may consist multiple block weights (31).

The external force transmission unit (40) is connected to the weight unit (30), and the seated user (20) can transmit an external force while gripping to move the weight unit (30) up and down by the applied external force.

Specifically, the external force transmission unit (40) is equipped with a pulley unit that changes the direction of the force applied to the external force application unit (43) in the vertical direction while stipulating the main external force body (41) connected to the support frame (10), the external force application unit (43) providing a space for gripping, the cable (45) mediating the external force application unit (43) and the weight unit (30), and the movement path of the cable (45).

Description of the external force transmitting unit (40) will be provided in detail with reference to Drawings 3 and 4 below.

Drawings 4 and 5 are schematic views that describes an external force transmission unit of an adjustable low pulley according to an embodiment of this invention.

In reference to Drawings 4 and 5, the main external force body (41) of this invention may be mounted on the external force support unit (13) to enable its up and down movement.

Specifically, multiple mounting holes (131) created along a height direction may be formed in the external force support unit (13), and the main external force body (41) can be mounted in any one of the mounting holes (131) by a separate fastening member of framework. It can be slid or fixed in the direction of the height depending on the fastening status performed by a separate fastening member of framework.

In addition, a series of numbers are displayed at positions corresponding to multiple mounting holes (131) on the external force support unit (13), which would allow the user to differentiate multiple mounting holes (131) easily.

The user can maximize the workout effect by changing the height of the main external force body (41) with respect to the external force support unit (13) depending on the weight the user.

The external force application unit (43) shall be equipped with a primary grip unit (431) connected to one end of the cable (45) and a secondary grip unit (432) connected to the other end of the cable (45).

The cable (45) may allow the external force applied by the user to be transmitted to the weight unit (30) by mediating the external force application unit (43) and the weight unit (30).

Specifically, one end of the cable (45) may be connected to the primary grip unit (431) and the other end may be connected to the secondary grip unit (432). The cable (45) passes through the weight unit (30) to allow for the weight unit (30) to move up and down by the external force arising from the primary grip unit (431) and the secondary grip unit (432), which would allow the user to perform actions of lifting or lowering the weight unit (30) using the external force application unit (43).

The pulley unit can change the direction of the force applied to the external force application unit (43) in the vertical direction while stipulating the movement path of the cable (45).

Specifically, the pulley unit shall include a primary main pulley piece (471), a secondary main pulley piece (472), a primary upper pulley piece (473), a weight pulley piece (474), a secondary upper pulley piece (477), and a lower pulley piece (475).

The primary main pulley piece (471) shall be connected to the main external force body (41) and can provide a space for winding of the cable (45). One end of the cable (45) wound around the primary main pulley piece (471) may be connected to the primary grip unit (431).

The secondary main pulley piece (472) shall be connected to the main external force body (41), can be placed adjacent to the primary main pulley piece (471), and can provide a space for winding of the cable (45). The other end of the cable (45) wound around the secondary main pulley piece (472) may be connected to the secondary grip unit (432).

The primary upper pulley piece (473) may be connected to an upper end of the standing support unit (15). Specifically, the primary upper pulley piece (473) may consist of a 1-1 upper pulley piece (473*a*) and a 1-2 upper pulley piece (473*b*) connected along the standing connection unit (153).

The primary upper pulley piece (473) may stipulate the movement path of the cable (45) to the upper weight unit (30) from the main external force body (41).

The weight pulley piece (474) may be connected to the weight unit (30).

The secondary pulley piece (477) can be connected to the upper end of the standing support unit (15) and placed on the upper side of the weight pulley piece (474).

The cable (45) hanging on the primary upper pulley piece (473) may be hanging on the secondary upper pulley piece (477) while passing through the weight pulley piece (474). The weight unit (30) can move up and down by the tension created by the cable (45) hanging on the primary upper pulley piece (473) and the secondary upper pulley piece (477).

The lower pulley piece (475) shall be connected to the bottom support unit (11) and may consist of a primary lower pulley piece (475*a*) and a secondary lower pulley piece (475*b*) that are placed apart from each other.

In summary, the cable (45) connected to the primary grip unit (431) passes through the primary main pulley piece (471), the primary upper pulley piece (473), the weight pulley piece (474), the secondary upper pulley piece (477), the lower pulley piece (475), and the secondary main pulley piece (472) in sequential order to be connected to the secondary grip unit (432).

The weight unit (30) may experience an increase in proportion to a moving distance of the primary grip unit (431) from the primary main pulley piece (471) or a moving distance of the secondary grip unit (432) from the secondary main pulley piece (472) by the user.

Drawing 6 is a schematic view that describes the weight unit and a stool support unit of an adjustable low pulley according to an embodiment of this invention.

In reference to Drawing 6, the weight unit (30) according to an embodiment of this invention shall include multiple block weights (31), a guide unit (33), and a weight adjustment unit (35).

Multiple block weights (31) can be connected to the standing support unit (15) to allow for up and down movement. Specifically, the standing support unit (15) is inserted into the hole created in the middle of multiple block weights (31), which would mean that multiple block weights (31) would remain dependent on the standing support unit (15), allowing it to move up and down in accordance with the standing support unit (15).

The guide unit shall include a through-hole formed in the block weight (31) while the lower end is connected to the floor support unit (11), and the upper end is connected to the upper end of the standing support unit (15) to guide the path of up and down movement of the block weight (31).

The block weight (31) may be equipped with a through-hole created as a mirror image of the center, and the guide unit (33) can be placed as a result of penetrating the through-hole created in a bar shape on both sides based on the center of the block weight (31). Therefore, the block weight (31) may move up or down without being rotated during its movement.

The weight adjustment unit (35) allows the position to be moved integrally using block weights (31) stacked on top of inserted block weights (31) by connecting to the upper end of the standing support unit and inserting it into the lower end of any one of the guide unit.

The support frame (10) according to an embodiment of this invention may further be equipped with a stool support unit (17) placed between the external force support unit (13) and the seat (20).

The stool support unit (17) may consist of a primary stool support piece (171) and a secondary stool support piece (172) that are placed apart from each other.

The low pulley (1) of this invention may further include a footrest unit (50).

The footrest unit (50) shall be connected to the stool support unit (17), and it also provides a space where the seated (23) user can place his or her feet.

Multiple mounting holes (173) created along a height direction may be formed in the above stool support unit (17), and the footrest unit (50) can be mounted in any one of the mounting holes (173) by a separate fastening member of framework. It can be slid or fixed in the direction of the height depending on the fastening status performed by a separate fastening member of framework.

In addition, a series of numbers are displayed at positions corresponding to multiple mounting holes (173) on the footrest unit (50), which would allow the user to differentiate multiple mounting holes (173) easily.

The user can maximize the workout effect by changing the height of the footrest unit (50) with respect to the stool support unit (17) depending on the weight the user.

The footrest unit (50) shall be equipped with a primary support piece (51) mounted on the primary stool support piece (171) and a secondary support piece (52) mounted on the secondary stool support piece (172).

The primary stool unit (51) shall be mounted on the primary stool support piece (171), and shall provide a hanging unit (513) to support the user's feet supported on the opposite sides with a mounting unit (511) providing opposite sides toward the seating units (23) and bent from the lower end of the above mounting unit (511).

The user can exercise while allowing the sole of the foot to be placed on the mounting unit (511) and placing the foot stably by allowing the heel of the foot to be hanging on the hanging unit (513).

Drawings 7 and 8 are schematic views that describes an adjustable low pulley according to a different embodiment of this invention.

In reference to Drawings 7 and 8, the adjustable low pulley (2) according to another embodiment of this invention shall further include a display unit (60), a rear cover unit (70), and a reinforcement support unit (80) in addition to the adjustable low pulley (1) described with reference to Drawings 1 or 6.

The display unit (60) is installed on the front side of the support frame (10*a*), and shall be installed to output an image specifically set by a user as a result of receiving an external communication signal. The display unit (60) is considered as an image output device which users can watch while exercising using the exercise equipment presented in this invention.

The rear cover unit (70) is installed on the rear side of the support frame (10*a*) to protect the weight unit (30) as well as a shield to protect the privacy of the seated user (20) during the workout.

The reinforcement support unit (80) may support to restrict the positional movement of the main external force body (141) connected to the external force support unit (13*a*) with respect to the external force support unit (13*a*).

The user can move or fix the position of the main external force body (141) along the height direction of the external force support unit (13*a*).

At this time, an external force may be applied consistently if the user exercises while the main external force body (141) is fixed to the external force support unit (13*a*). The reinforcement support unit (80) may restrict the positional movement of the main external force body unit (141) with respect to the external force support unit (13*a*) according to the continuous application of external force to the main external force body unit (141), which would allow the user to perform exercises in a more stable environment.

Drawing 9 is a schematic view that describes an adjustable low pulley according to another embodiment of this invention.

In reference to Drawing 9, the adjustable low pulley (3) according to another embodiment of this invention further includes a protective cover unit (91) and an accessory mounting unit (93) in addition to the adjustable low pulley (2) described with reference to Drawings 7 and 8, and also includes technical features concerning the footrest unit (50).

The protective cover unit (91) covers up the exterior of the external force support unit (13, see Drawing 3), the reinforcement support unit (80, see Drawing 7), and the cable (45, see Drawing 4), which would allow it to protect the described components from an unexpected external force applied from the outside.

The accessory mounting unit (93) is installed on the exterior of the secondary stool support piece (172') to provide a space for hanging accessories.

Specifically, the accessory mounting unit (93) is composed of a fixed mounting unit (931) installed on the secondary stool support piece (172') and a hook unit (933) connected to the above fixed mounting unit (931) in a ring form.

On the other hand, the footrest unit (50') may be mounted on the footrest support unit (17'), and it can be formed in different sizes compared to the described footrest unit (50, see Drawing 1) to allow it to be mounted on the stool support unit (17).

As an embodiment, it is obvious that the footrest unit (50') can be applied to footrests of different shapes and sizes.

The configuration and characteristics of this invention have been described above based on embodiments of this invention, however, the ideas concerning this invention shall not be limited to the presented examples, and it evidently states that the person skilled in the relevant field of technology is capable of making changes and modifications within the scope of the relevant idea. Therefore, it is clear that such changes or modifications shall belong to the appended scope of a request for a patent.

[Description of Signs]

| | |
|---|---|
| 1: Adjustable low pulley | 10: Support frame |
| 11: Floor support unit | 111: Floor mounting unit |
| 13: External force support unit | 15: Standing support unit |
| 17: Stool support unit | 171: Primary stool support unit |
| 172: Secondary stool support unit | 20: Seat |
| 21: Connection unit | 23: Seating unit |
| 30: Weight unit | 31: Block weight |
| 33: Guide unit | 35: Weight-adjusting unit |
| 40: External force transmission unit | 41: External force body unit |
| 43: External force application unit | 431: Primary grip unit |
| 432: Secondary grip unit | 45: Cable |
| 471: Primary main pulley piece | 472: Secondary main pulley piece |
| 473: Primary upper pulley piece | 474: Weight pulley piece |
| 477: Secondary upper pulley piece | 475: Lower pulley piece |

-continued

| [Description of Signs] | |
|---|---|
| 50: Footrest unit | 51: Primary stool unit |
| 511: Mounting unit | 513: Hanging unit |
| 52: Secondary stool unit | 60: Display unit |
| 70: Rear cover unit | 80: Reinforcement support unit |
| 91: Protective cover unit | 93: Accessory mounting unit |

The invention claimed is:

1. An adjustable low pulley, comprising:

a support frame;

a seat connected to the front of the support frame to provide a space for seating;

a weight unit connected to the support frame; and an external force transmission unit connected to the weight unit, wherein the external force transmission unit comprises:

a main external force body connected to the support frame;

an external force application unit connected to the weight unit by a cable; and a pulley unit changing the direction of the force applied to the external force application unit in the vertical direction, wherein the support frame comprises:

a floor support unit placed on a floor;

a standing support unit connected to the floor support unit;

an external force support unit connected to the standing support unit, wherein the seat comprises:

a connection unit formed in an "L" shape; and a seating unit connected to an upper end of the connection unit to provide a space for seating, wherein the support frame comprises:

a footrest support unit placed between the external force support unit and the seating unit; and a footrest unit connected to a stool support unit, wherein the stool support unit comprises a primary stool support piece and a secondary stool support piece placed apart from each other, wherein the footrest unit comprises:

a primary stool piece mounted on the primary stool support piece; and a secondary stool piece mounted on the secondary stool support piece, and wherein the primary stool piece comprises:

a mounting unit placed toward the seating unit; and a hanging unit bent from a lower end of the mounting unit.

2. The adjustable low pulley according to claim 1, wherein the external force application unit comprises:

a primary grip unit connected to one end of the cable; and a secondary grip unit connected to another end of the cable.

3. The adjustable low pulley according to claim 2, the pulley unit comprises:

a primary main pulley piece connected to the main external force body;

a secondary main pulley piece connected to the main external force boy and placed adjacent to the primary main pulley piece;

a primary upper pulley piece connected to the upper part of the standing support unit;

a weight pulley piece connected to the weight unit;

a secondary upper pulley piece placed on an upper side of the weight pulley piece; and a lower pulley piece connected to the floor support unit, wherein the cable connected to the primary grip unit passes through the primary main pulley piece, the primary upper pulley piece, the weight pulley piece, the secondary upper pulley piece, the lower pulley piece, and the secondary main pulley piece and is connected to the secondary grip unit.

4. The adjustable low pulley according to claim 3, the weight unit comprises:

multiple block weights connected to the standing support unit;

a guide unit penetrating a through-hole formed in the multiple block weights, a lower end of the guide unit being connected to the floor support unit, and an upper end of the guide unit being connected to an upper end of the standing support unit; and a weight adjustment unit inserted into one of the multiple block weights.

* * * * *